United States Patent [19]

Stotz et al.

[11] 3,947,317

[45] Mar. 30, 1976

[54] APPARATUS FOR ADJUSTING AND INDICATING POSITION OF A BREAST BOX LIP

[75] Inventors: Wolf Gunter Stotz, Ravensburg; Otto Hildebrand, Taldorf, both of Germany

[73] Assignee: Sulzer Brothers Limited, Winterthur, Switzerland

[22] Filed: Apr. 23, 1974

[21] Appl. No.: 463,277

[30] Foreign Application Priority Data

Apr. 24, 1973 Switzerland ..... 5806/73

[52] U.S. Cl. ..... 162/263; 162/347

[51] Int. Cl.[2] ..... D21F 7/06

[58] Field of Search ..... 162/263, 347, 344, 198, 162/199, 272

[56] References Cited

UNITED STATES PATENTS

| | | | |
|---|---|---|---|
| 2,384,912 | 9/1945 | Helin | 162/347 X |
| 2,418,600 | 4/1947 | Ostertag et al. | 162/344 X |
| 2,779,253 | 1/1957 | Owens | 162/344 |
| 3,575,799 | 4/1971 | Gedemer et al. | 162/347 X |

*Primary Examiner*—S. Leon Bashore
*Assistant Examiner*—Marc L. Caroff
*Attorney, Agent, or Firm*—Kenyon & Kenyon Reilly Carr & Chapin

[57] ABSTRACT

The adjusting rod of a lip adjusting mechanism is provided with an indicator which overlies a scale means on which a curved line representative of the lip motion is disposed. Movement of the lip from one position to another is indicated by movement of the indicator along the curved line. A scale is also used with the curved line to measure the displacement of the lip and, thus, the size of the gap defined in part by the lip.

8 Claims, 4 Drawing Figures

APPARATUS FOR ADJUSTING AND INDICATING POSITION OF A BREAST BOX LIP

This invention relates to an adjusting mechanism for a lip of a breast box of a paper making machine.

Paper making machines have been known to have a movable lip which defines a gap or nozzle duct with a vacuum breast roller. In such cases, adjusting mechanisms have been provided to move the lip relative to the breast roller in order to vary the size of the gap. One such adjusting mechanism has used an adjusting rod, which can be moved axially, and connecting rods, which are pivotally connected at the ends to the adjusting rod and lip. This mechanism can be very accurate if the gap bounded by the lip is narrow since the mechanism can be substantially simpler than previously known adjusting mechanisms.

It is an object of this invention to enable the particular adjustment of a movable lip of a paper making machine to be determined at any particular time from outside the paper making machine.

It is another object of the invention to provide a simple means for determining the position of a movable lip of a paper making machine.

It is another object of the invention to enable a starting position of a movable lip of a paper making machine to be established without a complicated adjustment of a lip adjusting mechanism.

Briefly, the invention provides a movable lip of a breast box of a paper making machine with an adjusting mechanism which measures the displacement of the lip toward and away from a breast roll of the machine over a range of positions from outside the machine. The lip serves to define, in part, a nozzle duct as is known. The adjusting mechanism includes an adjusting rod which is adjustable along a longitudinal axis, at least one connecting rod which is pivotally connected to the rod and lip at opposite ends, a means having an indicating line representative of the motion of the lip over the range of positions, and an indicator. The indicator extends transversely from the longitudinal axis of the adjusting rod for movement with the rod and is disposed over the indicating line to indicate the position of the lip.

The adjusting mechanism also includes a scale means which is adjustably mounted in the direction of the indicator and which includes a plurality of parallel lines parallel to the axis of the adjusting rod. The lines of the scale means cooperate with the indicating line to indicate the position of the lip and to measure the displacement of the lip from position to position.

In one embodiment, the indicating line is a curved line which corresponds to the relationship between the axial movement of the adjusting rod and the adjusting movement of the lip. With the use of the scale means, the adjustment of the lip can be very accurately read off.

The indicating line may be disposed on an element, such as a disc, while the scale lines are disposed on another element, such as a disc. In such case, the discs can be mounted in overlying manner with the front disc being transparent and the other disc disposed in back. This feature not only enables the lip adjustment to be accurately read off, but also enables the scale lines to be adjusted to different starting positions, i.e., selected minimum widths of the gap or nozzle duct defined in part by the lip.

The adjusting rod may also have an adjustable stop which limits the movement of the rod in the direction of reducing the width of the nozzle duct. The use of a stop of this kind enables a starting position for the width of the nozzle duct to be determined in accordance with operational requirements without complicated adjustment of the adjusting mechanism. As will be explained hereinafter, the zero position need not be altered. Nevertheless, the position of the lip at any particular moment in comparison with the starting position can always be read off, if the curve line and the scale lines are adjusted to a fresh starting position in the manner described below. The stop is screwthreaded onto the adjusting rod so as to be adjusted axially of the adjusting rod and cooperates with a shoulder rigidly attached to the machine. The result is a very simple and robust construction of the stop mechanism.

These and other objects and advantages of the invention will become more apparent from the following detailed description taken in conjunction with the accompanying drawings in which.

Figure 1:
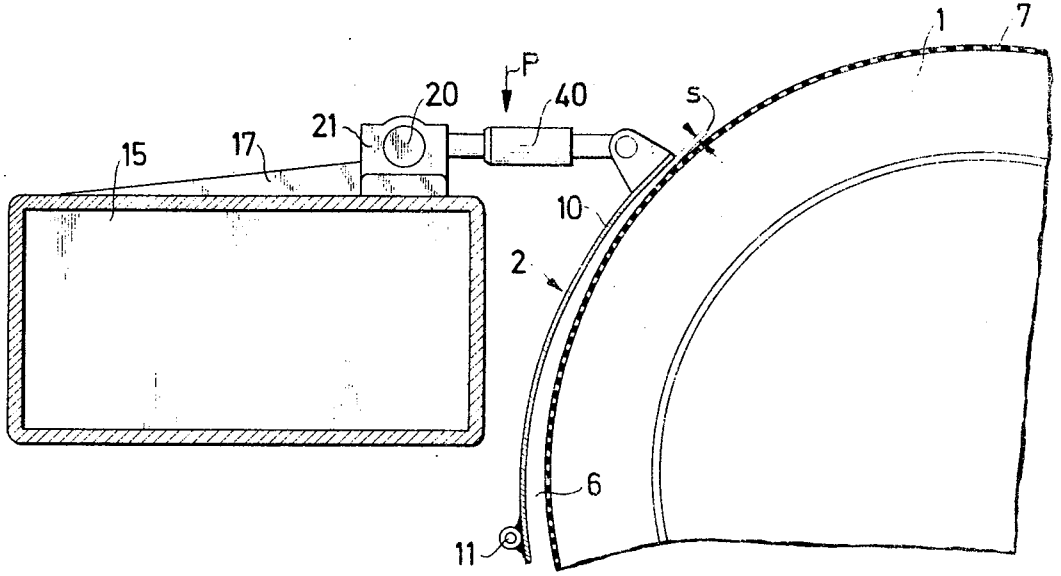
FIG. 1 illustrates a cross-sectional view of a paper making machine utilizing an adjusting mechanism according to the invention.

Referring to FIG. 1, a paper making machine includes a vacuum breast roll or roller 1 having a breast box 2 containing a nozzle duct 6 for the feed of pulp, i.e. a fiber containing suspension in water. The roller 1 includes a permeable element 7 which can, for instance, be a round or elongate screen on which the pulp is placed from the nozzle duct 6. As shown, the nozzle duct 6 is defined, in part, by the roller 1 and, in part, by a lip 10.

The lip 10 is movably mounted relative to the roller 1. For example, the lip 10 is pivoted by a hinge 11 secured to another part of the machine.

Figure 2:
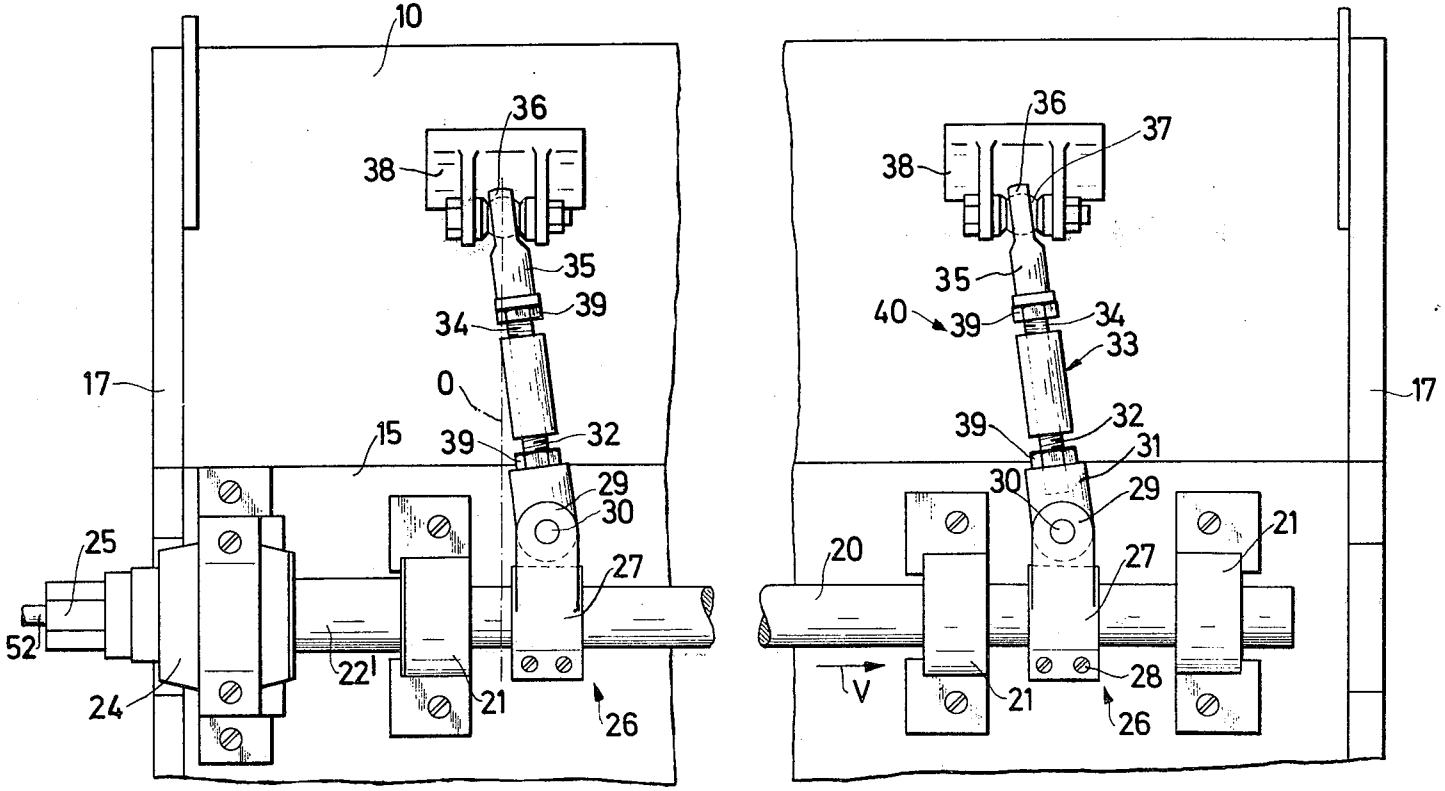
FIG. 2 illustrates a partial plan view of the adjusting mechanism taken in the direction of the arrow P in FIG. 1.

Referring to FIGS. 1 and 2, an adjusting mechanism is mounted on the machine to move the lip 10. This mechanism includes an adjusting rod 20 which extends parallel to the axis of the hinge 11 and is adjustable along a longitudinal axis within bearings 21. These bearings 21 are attached to a support 15 which extends transversely of the paper making machine. The ends of the support 15 are in turn attached to lateral plates 17 at both ends of the paper making machine.

Figure 3:
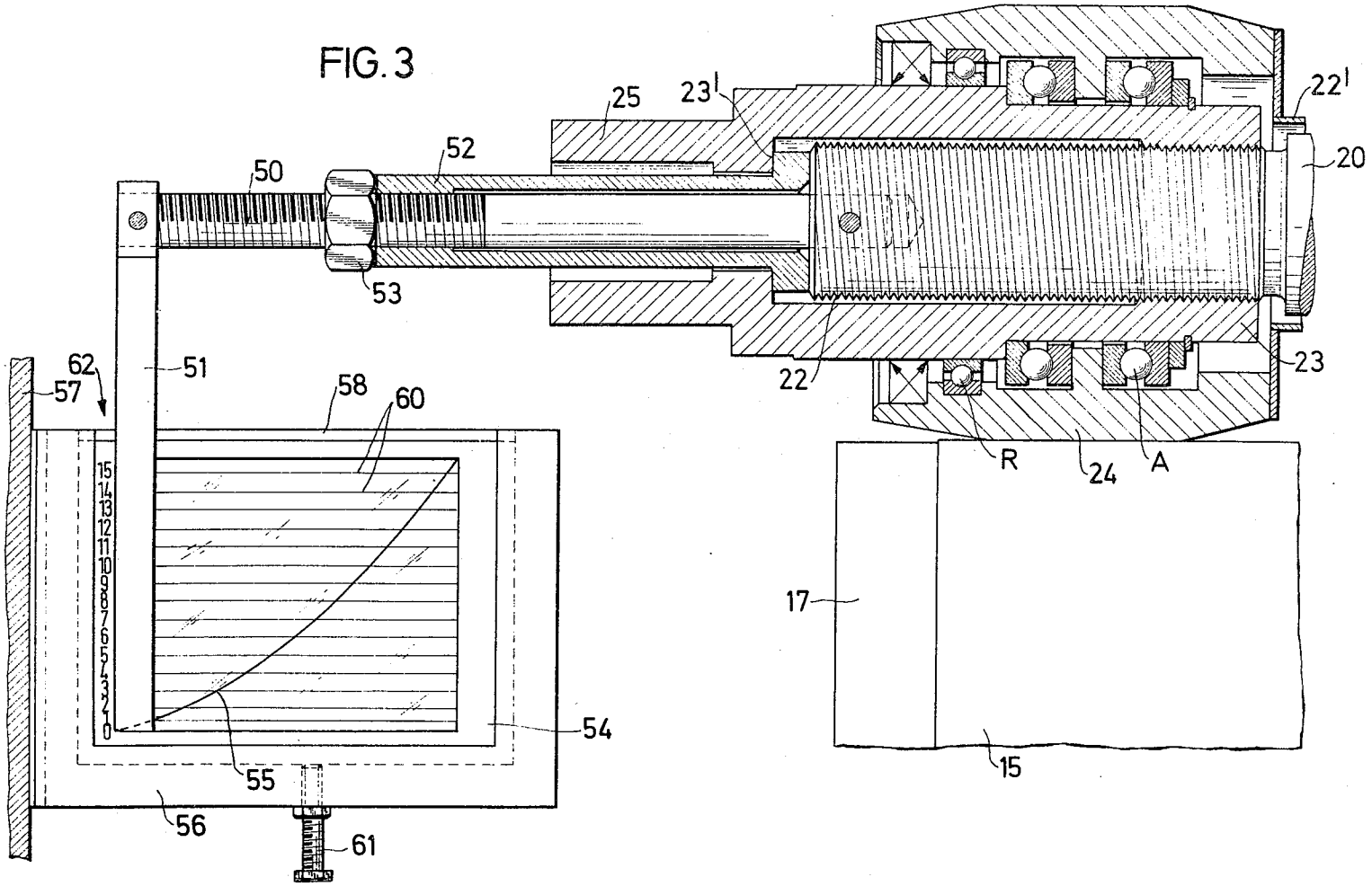
FIG. 3 illustrates a detail of the adjusting mechanism including an indicator in accordance with the invention.
Figure 4:
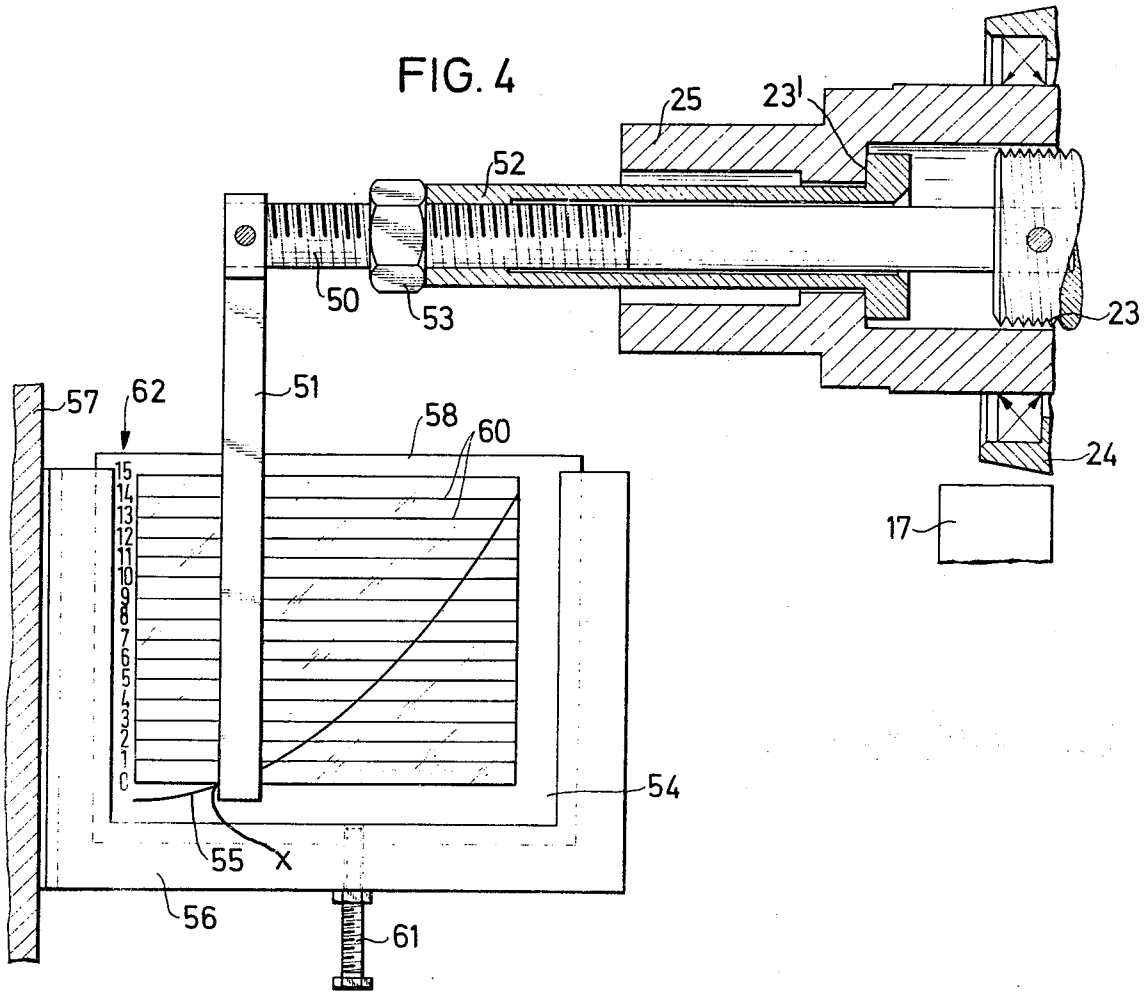
FIG. 4 illustrates the adjusting mechanism with the indicator in a different starting position.

As shown in FIGS. 3 and 4, the left-hand end of the adjusting rod 20, as viewed, has a screwthreading 22 which is threaded into a screwthreaded socket 23 which is rotatably mounted by thrust bearings A and radial bearings R in a fixed bearing casing 24. The socket 23 has an adjusting pin 25 which is formed with an outer hexagonal surface for adjustment by a suitable tool. As also shown in FIGS. 2 and 3, that part of the adjusting rod 20 which is disposed between the bearing casing 24 and the adjoining bearing 21 is enclosed in a protective tube 22' to protect the screwthreading 22.

As shown in FIG. 2, connectors 26 are attached to the adjusting rod 20 which extends over the whole width of the paper-making machine and can therefore be very long. Each connector 26 contains a cylindrical hub 27 which is clamped by screws 28 on the adjusting rod 20. Each connector 26 also contains projecting lugs 29 through which a pin 30 extends. The pin 30 is mounted in a part 31 into which is screwthreaded pin 32 of a screwthreaded rod 33 is screwed. The outer end of the screwthreaded rod 31 also has screwthreaded pin 34 which is screwed into a part 35 having a lug 36 at the end. The screwthreaded pins 32,34 of the screwthreaded rod 33 have either screwthreadings with a different direction of rotation or screwthreadings which have the same direction of rotation, but different pitches. The lug 36 encloses a spherical pin 37 attached to a bearing part 38. The screwthreaded pins 32, 34 also have locking nuts 39. The parts 31, 33, 35 cooperate to form a connecting rod 40. Although only two connecting rods are shown in the drawings, a larger number can of course be provided.

The basic position of the adjusting mechanism, the so-called zero position, is the position in which the axes of the connecting rods 40 lie in planes O extending perpendicularly to the adjusting rod 20. If then the adjusting rod 20 is moved axially i.e. linearly in the direction indicated by the arrow V, the lip 10 is removed from the breast roller 1 by the connecting rods 40. When the adjusting rod 20 makes a movement in uniform steps, the lip 10 is first lifted slowly and then more and more quickly.

As shown in FIGS. 3 and 4, an indicator rod 50 extends outwardly from the screwthreaded socket 23 and is attached coaxially to the end of the adjusting rod 20. In addition, an indicator 51 is attached to the end of the indicator rod 50. The indicator 51 is in the form of a straight pointer 51 and extends perpendicularly to the axis of the adjusting rod 20 and indicator rod 50. The indicator rod 50 which acts as an extension of the adjusting rod 20 has a screw-threading onto which a stop 52 is threaded. In addition, a lock nut 53 is threaded onto the rod 50 to lock the stop 52 in position.

A disc is associated with the indicator 51 and has a curved line 55 formed thereon which is representative of the relationship between the axial movement V of the adjusting rod 20 and the adjusting movement of the lip 10. For example, the line 55 is a portion of a sine curve. The disc 54 is mounted in a holder 56 which is secured on a stationary machine part 57. In addition, the disc 54 is transparent.

A second disc 58 is also mounted behind the transparent disc 54. The second disc constitutes a scale means which has a plurality of scale lines 60 parallel with the axis of the adjusting rod 20. The respective lines 60 have corresponding indicia 62 such as printed numbers or pins. This scale disc 58 is adjustably mounted in the holder 56 by a screw 61 so as to be moved in the direction of the indicator 51, i.e., upwards and downwards as viewed.

Rotation of the screwthreaded socket 23 produces adjusting movements of the adjusting rod 20 and therefore changes in the width of the gap S (FIG. 1), representing the outlet end of the nozzle duct 6. When the adjusting rod 20 makes a movement to the left (FIG. 2), the gap S is reduced and is increased in the case of a movement in the opposite direction.

When the connecting rods 40 are in the zero position in which their axes lie in the planes O, the adjusting mechanism and the indicator 51 are disposed in the position illustrated in FIG. 3. The stop 52 touches a shoulder 23' of the screwthreaded socket 23 so that the rod 20 cannot make a movement to the left. In this sense, the shoulder 23' acts as a fixed shoulder of the paper making machine. A movement of the rod 20 to the right increases the gap S. The indicator 51 is moved along the curved line 55 while the indicia 62 associated with the scale lines 60 directly indicate the size of the gap S. Even fractions of integers can be estimated. Due to the initially shallow course followed by the curved line 55, the adjustment of the gap S can be relatively accurate, although with increasing size of the gap S, the accuracy decreases. This precisely corresponds to operational requirements.

If a different minimum width of the nozzle duct (gap S) is required, the lengths of the connecting rods 40 can be altered to adjust a fresh zero position. However, the adjusting mechanism can be adjusted in a much simpler manner by the displacement of the adjusting rod 20, so that the lip 10 moves into a fresh starting position with the required gap width S. The stop part 52 can then be screwed so far to the left (FIG. 3) as to abut the shoulder 23'. This position is shown in FIG. 4. Lastly, the scale disc 58 can be so adjusted by the screw 61 that the scale line O is situated at the point X of intersection of the measuring edge of the indicator 51 with the curved line 55.

With a starting position adjusted in this way, the adjusting rod 20 as shown in FIG. 4 is prevented by the stop part 52 from moving further to the left. All that can happen is an increase in the size of the gap S due to the movement of the adjusting rod 20 to the right (FIG. 4). The increase over the starting position can be read off by means of the curved line 55 and the scale line 60. Preferably, therefore, the zero position, at which the connecting rods 40 are perpendicular to the adjusting rod 20, can be so selected as to produce the minimum width of the nozzle duct and gap S ever occurring during operation.

What is claimed is:

1. In combination with a breast roll and a movable lip of a breast box of a paper making machine, said lip being movable over a range of positions toward and away from said breast roll; an adjusting mechanism comprising an adjusting rod, said rod being adjustable along a longitudinal axis of said rod parallel to the transverse width of said lip; at least one connecting rod disposed on an axis transverse to said longitudinal axis and being pivotally connected to said adjusting rod at one end of said connecting rod and to said lip at an opposite end of said connecting rod; means having an indicating line representative of the motion of said lip in said range; an indicator extending transversely from said longitudinal axis of said adjusting rod for movement with said adjusting rod, said indicator being disposed over said indicating line to indicate the position of said lip in said range.

2. The combination as set forth in claim 1 wherein said line is a curved line corresponding to a relationship between the axial movement of said adjusting rod and an adjusting movement of said lip, and wherein said means includes a scale means for measuring the displacement of said lip.

3. The combination as set forth in claim 2 wherein said scale means is adjustably mounted relative to said indicator and includes a plurality of parallel lines parallel to said axis of said adjusting rod for measuring the displacement of said lip.

4. The combination as set forth in claim 3 wherein said line is disposed on a first disc and said scale means is a second disc, and wherein one of said disc is transparent and the other of said discs is disposed behind said transparent disc.

5. The combination as set forth in claim 1 which further comprises an adjustable stop on said adjusting rod for limiting movement of said adjusting rod along said axis in a direction to narrow a gap defined in part by said lip.

6. The combination as set forth in claim 5 which further comprises a fixed shoulder on the paper making machine and wherein said adjustable stop is threaded onto said adjusting rod to abut said shoulder to limit movement of said adjusting rod in said direction.

7. In combination with a breast roll and a movable lip of a breast box of a paper making machine, said lip being movable over a range of positions toward and away from said breast roll; an adjusting mechanism comprising a rotatably mounted socket;

an adjusting rod adjustably mounted in said socket along a longitudinal axis of said rod parallel to the transverse width of said lip;

a plurality of connecting rods disposed on axes transverse to said longitudinal axis, each said connecting rod being pivotally connected to said adjusting rod at one end of said connecting rod and to said lip at an opposite end of said connecting rod;

means having an indicating line representative of the motion of said lip in said range;

an indicator rod attached to said adjusting rod for movement with said adjusting rod and extending from said socket; and an indicator attached to said indicator rod and extending perpendicularly to said axis for movement with said indicator rod, said indicator being disposed over said indicating line to indicate the position of said lip in said range.

8. In combination with a breast roll and a movable lip of a breast box of a paper making machine, said lip being movable over a range of positions toward and away from said breast roll; an adjusting mechanism comprising a fixed bearing casing;

a screwthreaded socket rotatably mounted in said casing;

an adjusting rod threadably mounted in said socket for linear movement axially of a longitudinal axis of said rod parallel to the transverse width of said lip;

at least one connecting rod disposed on an axis transverse to said longitudinal axis and being pivotally connected at one end thereof to said adjusting rod and at an opposite end thereof to said lip;

means having an indicating line representative of the motion of said lip in said range;

an indicator rod attached to said adjusting rod for movement with said adjusting rod and extending from said socket; and an indicator attached to said indicator rod and extending perpendicularly to said axis for movement with said indicator rod, said indicator being disposed over said indicating line to indicate the position of said lip in said range.

* * * * *